US008512487B2

(12) United States Patent
Yamazaki et al.

(10) Patent No.: US 8,512,487 B2
(45) Date of Patent: Aug. 20, 2013

(54) SEAMLESS EXPANDABLE OIL COUNTRY TUBULAR GOODS AND MANUFACTURING METHOD THEREOF

(75) Inventors: Yoshio Yamazaki, Aichi (JP); Yukio Miyata, Aichi (JP); Mitsuo Kimura, Aichi (JP); Kei Sakata, Aichi (JP); Masahito Tanaka, Aichi (JP)

(73) Assignee: JFE Steel Corporation (JP)

( * ) Notice: Subject to any disclaimer, the term of this patent is extended or adjusted under 35 U.S.C. 154(b) by 87 days.

(21) Appl. No.: 10/573,277

(22) PCT Filed: Oct. 18, 2004

(86) PCT No.: PCT/JP2004/015751

§ 371 (c)(1),
(2), (4) Date: Mar. 23, 2006

(87) PCT Pub. No.: WO2005/038067

PCT Pub. Date: Apr. 28, 2005

(65) Prior Publication Data

US 2007/0116975 A1 May 24, 2007

(30) Foreign Application Priority Data

Oct. 20, 2003 (JP) ..... 2003-359009

(51) Int. Cl.
*C21D 9/08* (2006.01)

(52) U.S. Cl.
USPC ..... 148/593; 148/333; 148/328; 420/120

(58) Field of Classification Search
USPC ..... 148/593
See application file for complete search history.

(56) References Cited

U.S. PATENT DOCUMENTS

| | | | | |
|---|---|---|---|---|
| 4,437,902 | A | 3/1984 | Pickens et al. | |
| 5,873,960 | A * | 2/1999 | Kondo et al. | 148/593 |
| 6,290,789 | B1 * | 9/2001 | Toyooka et al. | 148/593 |
| 2003/0051782 | A1 * | 3/2003 | Toyooka et al. | 148/593 |
| 2005/0217768 | A1 * | 10/2005 | Asahi et al. | 148/593 |

FOREIGN PATENT DOCUMENTS

| | | | |
|---|---|---|---|
| CA | 2008853 | A * | 7/1991 |
| EP | 0757113 | A1 | 2/1997 |
| EP | 1325967 | A1 | 7/2003 |
| JP | 06-172855 | A | 6/1994 |
| JP | 10-017980 | A | 1/1998 |
| JP | 10-176239 | A | 6/1998 |
| JP | 2003-201543 | A | 7/2003 |
| WO | WO 98/00626 | A1 | 1/1998 |

* cited by examiner

*Primary Examiner* — Roy King
*Assistant Examiner* — Christopher Kessler
(74) *Attorney, Agent, or Firm* — DLA Piper LLP (US)

(57) ABSTRACT

A seamless expandable oil country tubular article, which has a superior pipe expansion property in a expanding process at an expand ratio of more than about 30% although having a high strength such as a tensile strength (TS) of about 600 MPa or more, and a manufacturing method thereof, the seamless expandable oil country tubular goods being in an as-rolled state or being processed, optionally necessary, by inexpensive nonthermal-refining type heat treatment.

6 Claims, 3 Drawing Sheets

PATTERN I OF DUAL-PHASE HEAT TREATMENT

PATTERN II OF DUAL-PHASE HEAT TREATMENT

PATTERN III OF DUAL-PHASE HEAT TREATMENT

PATTERN IV OF DUAL-PHASE HEAT TREATMENT

SEAMLESS EXPANDABLE OIL COUNTRY TUBULAR GOODS AND MANUFACTURING METHOD THEREOF

TECHNICAL FIELD

This invention relates to seamless expandable oil country tubular goods used in oil wells or gas wells (hereinafter collectively referred to as "oil wells") and manufacturing methods thereof. The invention relates to seamless expandable oil country tubular goods that can be expanded in a well and can be used as a casing or a tubing without any additional treatment. More particularly, the invention relates to seamless expandable oil country tubular goods having a tensile strength of 600 MPa or more and a yield ratio of 85% or less and a manufacturing method thereof. The steel pipes used in oil wells are called "oil country tubular goods".

BACKGROUND

In recent years, due to the requirement of reduction in cost for drilling of oil wells, construction methods have been developed in which pipe expansion is performed in a well using an expanding process (see, for example, PCT Japanese Translation Patent Publication No. 7,507,610 and WO 98/00626). Hereinafter, this construction method is called a "solid expandable tubular system." According to this solid expandable tubular system, a casing is expanded radi-ally in a well. Compared to a conventional construction method, when the same well radius is to be ensured, each of the diameters of individual sections forming a casing having a multistage structure can be decreased. In addition, since the size of a casing for an exterior layer of an up-per portion of the well can also be decreased, the cost for drilling a well can be reduced.

In the solid expandable tubular system described above, since being exposed to oil or gas environment immediately after a expanding process is carried out, steel pipes thus formed are not processed by heat treatment after the process described above, and hence the steel pipes are required to have corrosion resistance as cold expanded. In order to satisfy the requirement described above, Japanese Unexamined Patent Application Publication No. 2002-266055 discloses expandable oil country tubular goods having superior corrosion resistance after a expanding process. JP '055 discloses the expandable oil country tubular goods comprising 0.10% to 0.45% of C, 0.1% to 1.5% of Si, 0.10% to 3.0% of Mn, 0.03% or less of P, 0.01% or less of S, 0.05% or less of sol. Al, and 0.010% or less of N are contained on a mass percent basis, the balance being composed of Fe and impurities. JP '055 discloses a steel pipe, in which the strength (yield strength YS (MPa)) before a expanding process and the crystal grain diameter (d(μm)) satisfy an equation represented by $\ln(d) \leqq -0.0067YS+8.09$. In addition, it has also been disclosed that, in the same steel pipe described above, (A) at least one of 0.2% to 1.5% of Cr, 0.1% to 0.8% of Mo, and 0.005% to 0.2% of V on a mass percent basis, (B) at least one of 0.005% to 0.05% of Ti and 0.005% to 0.03% of Nb on a mass percent basis, and (C) at least one of 0.001% to 0.005% of Ca are contained instead of a part of the Fe.

In addition, Japanese Unexamined Patent Application Publication No. 2002-349177 discloses that, in order to prevent the decrease in collapse strength caused by the increase in rate of wall-thickness deviation by pipe expansion, the rate of wall-thickness deviation EO (%) before pipe expansion is controlled to be $30/(1+0.018\alpha)$ or less (where a (expand ratio)=(inside diameter after pipe expansion/inside diameter before pipe expansion−1)×100). In addition, in order to prevent a steel pipe from being bent which is caused by the conversion of the difference in expansion amount in the circumferential direction to the difference in contraction amount in the longitudinal direction, JP '177 discloses that the rate of eccentric wall-thickness deviation (primary wall-thickness deviation) (%) (={(maximum wall thickness of a component of eccentric wall-thickness deviation−minimum wall thickness thereof)/average wall thickness}×100) is controlled to be 10% or less.

According to JP '055 and JP '177, a preferable manufacturing method has been disclosed in which quenching and tempering are performed for electric resistance welded steel pipes or seamless steel pipes obtained after pipe forming or in which quenching is repeatedly performed therefor at least two times, followed by tempering, and an example has been disclosed in which a expanding process is performed within an expand ratio of 30% or less.

Due to further cost reduction needs, inexpensive steel pipes have been desired which can withstand an expanding process performed at a high expansion ratio, such as more than 30%. When a steel pipe can be expanded in a well at an expansion ratio larger than a conventional value of 30%, the size of casing can be further decreased and, hence, the drilling cost can be further decreased. In order to satisfy the need described above, it would be advantageous to provide seamless expandable oil country tubular goods, which have excellent pipe-expansion properties capable of withstanding an expanding process at an expansion ratio of more than 30% although having a high strength, such as a tensile strength (TS) of 600 MPa or more, and a manufacturing method thereof. In addition, unlike the case disclosed in JP '055 and JP '177, without receiving quenching and tempering (Q/T) treatment, the seamless expandable oil country tubular goods described above should be in an as-rolled state or processed by nonthermal-refining type heat treatment (normalizing (annealing) treatment or dual-phase heat treatment) which is a less expensive heat treatment.

SUMMARY

One aspect provides a seamless expandable oil country tubular goods in which about 0.010% to less than about 0.10% of C, about 0.05% to about 1% of Si, about 0.5% to about 4% of Mn, about 0.03% or less of P, about 0.015% or less of S, about 0.01% to about 0.06% of Al, about 0.007% or less of N, and about 0.005% or less of 0 are contained; at least one of Nb, Mo, and Cr is contained in the range of about 0.01% to about 0.2% of Nb, about 0.05% to about 0.5% of Mo, and about 0.05% to about 1.5% of Cr, so that the equations (1) and (2) are satisfied; and Fe and unavoidable impurities are contained as the balance:

$$Mn+0.9\times Cr+2.6\times Mo \geqq 2.0 \quad (1)$$

$$4\times C-0.3\times Si+Mn+1.3\times Cr+1.5\times Mo \leqq 4.5 \quad (2).$$

In the above equations, the symbol of the elements represents the content (mass percent) of the element contained in the steel.

Instead of a part of the Fe mentioned above, at least one of about 0.05% to about 1% of Ni, about 0.05% to about 1% of Cu, about 0.005% to about 0.2% of V, about 0.005% to about 0.2% of Ti, about 0.0005% to about 0.0035% of B, and about 0.001% to about 0.005% of Ca may be contained.

In addition, instead of equations (1) and (2), equations (3) and (4) may be satisfied:

$$Mn+0.9\times Cr+2.6\times Mo+0.3\times Ni+0.3\times Cu\geqq 2.0 \quad (3)$$

$$4\times C-0.3\times Si+Mn+1.3\times Cr+1.5\times Mo+0.3\times Ni+0.6\times Cu\leqq 4.5 \quad (4).$$

In the above equations, the symbol of the elements represents the content (mass percent) of the element contained in the steel.

In addition, the microstructure of a steel pipe preferably contains ferrite at a volume fraction of about 5% to about 70% and the balance substantially composed of a low temperature-transforming phase.

The term "substantially" implies that a third phase (other than ferrite and the low temperature-transforming phase) having a volute fraction of less than 5% is allowed to exist. As the third phase, for example, pearlite, cementite, or retained austenite may be mentioned.

Another aspect provides a method for manufacturing a seamless expandable oil country tubular goods comprising: heating a raw material for a steel pipe, the raw material containing, on a mass percent basis, about 0.010% to less than about 0.10% of C, about 0.05% to about 1% of Si, about 0.5% to about 4% of Mn, about 0.03% or less of P, about 0.015% or less of S, about 0.01 to about 0.06% of Al, about 0.007% or less of N, and about 0.005% or less of O, at least one of about 0.01% to about 0.2% of Nb, about 0.05% to about 0.5% of Mo, and about 0.05% to about 1.5% of Cr, optionally at least one of about 0.05% to about 1% of Ni, about 0.05% to about 1% of Cu, about 0.005% to about 0.2% of V, about 0.005% to about 0.2% of Ti, about 0.0005% to about 0.0035% of B, and about 0.001% to about 0.005% of Ca, so that equations (3) and (4) are satisfied, and Fe and unavoidable impurities as the balance; forming a pipe by a seamless steel pipe-forming process (seamless pipe-forming process) which is performed at a rolling finish temperature of about 800° C. or more; and optionally performing normalizing treatment after the pipe forming is performed by the seamless steel pipe-forming process.

Another aspect provides a method for manufacturing seamless expandable oil country tubular goods comprising: after heating the raw material for a steel pipe described above, and pipe forming is performed by a seamless steel pipe-forming process, holding the pipe thus formed in a region of from point $A_1$ to point $A_3$, that is, in an ($\alpha/\gamma$) dual-phase region, for about five minutes or more as a final heat treatment, and then performing air cooling.

DETAILED DESCRIPTION

Figure 1:
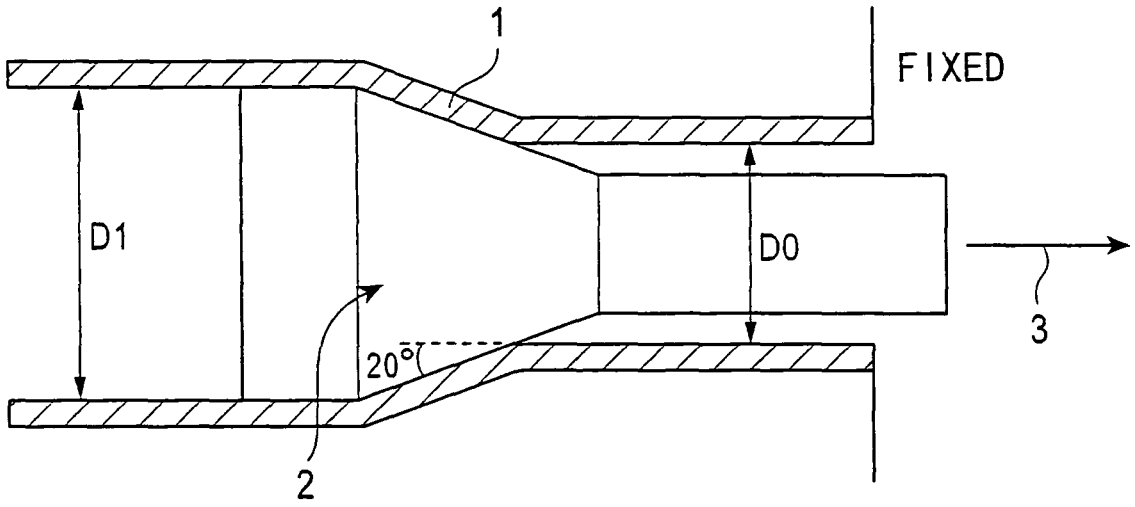
FIG. 1 is a longitudinal cross-sectional view showing the structure used for a pipe-expansion test. Reference numerals 1, 2, and 3 indicate a steel pipe, a plug, and a direction in which the plug is drawn out, respectively.

The pipe-expansion property described above should be evaluated by limiting the expansion ratio at which expansion can be performed without causing non-uniform deformation of a pipe when it is expanded and, in particular, an expansion ratio at which the rate of wall-thickness deviation after expansion is not more than the rate of wall-thickness deviation before expansion+5% is used.

Expansion Ratio (%)=((inside diameter of pipe after pipe expansion−inside diameter of pipe before pipe expansion)/inside diameter of pipe before pipe expansion)×100

Rate of Wall-Thickness Deviation=((maximum wall thickness of pipe−minimum wall thickness of pipe)/average wall thickness of pipe)×100

Major properties required for an expandable steel pipe are that pipe expansion can be easily performed, that is, can be performed using little energy, and that in pipe expansion even at a high expansion ratio, a steel pipe is not likely to be unevenly deformed so that uniform deformation is obtained. To perform easy pipe expansion, a low YR (YR: yield ratio=yield strength YS/tensile strength TS) is preferable and, in addition, to obtain uniform deformation even at a high expansion ratio, a high uniform elongation and a high work-hardening coefficient are preferred.

We found that a preferable microstructure of a steel pipe substantially contains ferrite (volume fraction of 5% or more)+a low temperature-transforming phase (bainite, martensite, bainitic ferrite, or a mixture containing at least two thereof) and, hence, carried out experiments to realize the microstructure described above.

First, the content of C was controlled to be less than about 0.1% to suppress the formation of pearlite and increase the toughness, Nb was further added which was an element having the effect of delaying transformation and, subsequently, the content of Mn forming a microstructure containing ferrite and a low temperature-transforming phase was examined. Formation of a predetermined microstructure by cooling a pipe from a γ region was defined as an essential condition, and by the use of a steel pipe having an external diameter of 4" to 9⅝" and a wall thick-ness of 5 to 12 mm, which has been applied to an expandable steel pipe, as the standard pipe, we obtained a predetermined microstructure by a cooling rate which is generally applied to the size of the steel pipe described above. Although depending on the cooling circumstances, the average cooling rate is approximately 0.2 to approximately 2° C./sec in the range of approximately 700 to approximately 400° C.

As a result, it was found that, when the content of Mn is about 2% to about 4%, ferrite is formed and a low temperature-transforming phase is formed without forming pearlite. In addition, it was also found that when a predetermined amount of Mo or Cr, which is also an element having the effect of delaying transformation, is added instead of Nb, the same effect as described above is obtained.

We also found that, when the content of Mn is controlled to be about 0.5% or more, and an alloying element is added so that equation (1) or (3) holds, the formation of pearlite is suppressed. In addition, it was also disclosed that, since a ferrite microstructure is no longer formed when a large amount of an alloying element is added, the addition thereof must be performed to satisfy equation (2) or (4) for forming a ferrite microstructure. That is, by satisfying both equations, a microstructure containing ferrite and a low temperature-transforming phase can be formed and, hence, a steel pipe having a high expand ratio and a low YR can be obtained:

$$Mn+0.9\times Cr+2.6\times Mo\geqq 2.0 \quad (1)$$

$$4\times C-0.3\times Si+Mn+1.3\times Cr+1.5\times Mo\leqq 4.5 \quad (2)$$

$$Mn+0.9\times Cr+2.6\times Mo+0.3\times Ni+0.3\times Cu\geqq 2.0 \quad (3)$$

$$4\times C-0.3\times Si+Mn+1.3\times Cr+1.5\times Mo+0.3\times Ni+0.6\times Cu\geqq 4.5 \quad (4).$$

In the above equations, the symbol of an element represents the content (mass percent) of the element contained in the steel.

From steel developed based on the above findings, a predetermined microstructure containing ferrite and low temperature-transforming phase can be obtained by air cooling performed from the γ region and, in addition, it was also found that, when that steel is held in an (α/γ) dual-phase region, followed by air cooling, the YR can be further decreased.

The reason the pipe-expansion property is improved by the formation of a dual-phase microstructure is not fully understood in detail. However, we believe that, by formation of a dual-phase microstructure, the work-hardening coefficient is increased, a thin wall portion first has a deformation strength equivalent to or more than that of a thick wall portion in an expanding process, deformation of the thick wall portion is subsequently promoted and, as a result, the working coefficient becomes uniform. On the other hand, we believe that, in single-phase steel, such as a Q/T material, having a high YR and a low work-hardening coefficient, deformation of a thin wall portion preferentially occurring as an expanding process is performed and, hence, deformation reaches the limit of the expansion ratio at an early stage.

We also found that when Q/T treatment, which is considered as a preferable process in conventional techniques is not intentionally used, and steel containing an alloying component (including equation) is used which is in an as-rolled state or which is processed by a nonthermal-refining type heat treatment, the steel can be easily expanded although having a high strength, and that a high expansion ratio can be realized. We also believe that the properties described above can be obtained since the microstructure thus obtained contains ferrite and a low temperature-transforming phase.

The reasons the composition of steel is specified as above will be described. The content of the component contained in the composition is represented by mass percent and is abbreviated as %.

C: about 0.010% to less than about 0.10%

To achieve the formation of a dual-phase microstructure containing ferrite and a low temperature-transforming phase by a general seamless pipe-forming process, low C-high Mn—Nb based steel or steel which contains at least one of an alloying element instead of high Mn and an element (Cr, Mo) instead of Nb must be used, in which the alloying element satisfies the equation (3) and the element (Cr, Mo) has an effect of delaying transformation similar to that of Nb. However, when C is about 0.10% or more, pearlite may be formed and, on the other hand, when C is less than about 0.010%, the strength becomes insufficient. Hence, the content of C is set in the range of about 0.010% to less than about 0.10%.

Si: about 0.05% to about 1%

Si is added as a deoxidizing agent and contributes to the increase in strength. However, when the content is less than about 0.05%, the effect cannot be obtained and, on the other hand, when the content is more than about 1%, in addition to serious degradation in hot workability, the YR is increased so that the pipe-expansion property is degraded. Hence, the content of Si is set in the range of about 0.05% to about 1%.

Mn: about 0.5% to about 4%

Mn is an important element for forming a low temperature-transforming phase. In the case in which a low C and an element having an effect of delaying transformation (Nb, Cr, Mo) form a composite, when Mn is an only element added to the composite, Mn at a content of about 2% or more can achieve the formation of a dual-phase microstructure containing ferrite and a low-temperature-transforming phase, and when Mn is added together with another alloying element so that equation (3) is satisfied, Mn at a content of 0.5% or more can achieve the formation described above. However, when the content is more than about 4%, segregation may seriously occur and, as a result, toughness and pipe-expansion properties are degraded. Hence, the content of Mn is set in the range of about 0.5% to about 4%.

P: about 0.03% or Less

P is contained in steel as an impurity and is an element that may cause grain boundary segregation. Hence, when the content is more than about 0.03%, the grain boundary strength is seriously decreased and, as a result, toughness is decreased. Hence, the content of P is controlled to be about 0.03% or less and is preferably set to about 0.015% or less.

S: about 0.015% or Less

S is contained in steel as an impurity and is present primarily as an inclusion of an Mn-based sulfide. When the content is more than about 0.015%, S is present as an extended large and coarse inclusion and, as a result, the toughness and the pipe-expansion property are seriously degraded. Hence, the content of S is controlled to be about 0.015% or less and is preferably set to about 0.006% or less. In addition, the structural control of the inclusion by Ca is also effective.

Al: about 0.01% to about 0.06%

Al is used as a deoxidizing agent; however, when the content is less than about 0.01%, the effect is small, and when the content is more than about 0.06%, in addition to the saturation of the effect, the amount of an alumina-based inclusion is increased, thereby degrading the toughness and the pipe-expansion property. Hence, the content of Al is set in the range of about 0.01% to about 0.06%.

N: about 0.007% or Less

N is contained in steel as an impurity and forms a nitride by bonding with an element such as Al or Ti. When the content is more than about 0.007%, a large and coarse nitride is formed and, as a result, toughness and pipe-expansion properties are degraded. Hence, the content of N is controlled to be about 0.007% or less and is preferably set to about 0.005% or less.

O: about 0.005% or Less

O is present in steel as an inclusion. When the content is more than about 0.005%, the inclusion tends to be present in a coagulated form and, as a result, toughness and pipe-expansion properties are degraded. Hence, the content of O is controlled to be about 0.005% or less and is preferably set to about 0.003% or less.

In addition to the elements described above, at least one of Nb, Mo, and Cr is added in the range described below.

Nb: about 0.01% to about 0.2%

Nb is an element suppressing formation of pearlite and contributes to formation of a low temperature-transforming phase in a composite containing high C and high Mn. In addition, Nb contributes to the increase in strength by formation of a carbonitride. However, when the content is less than about 0.01%, the effect cannot be obtained and, on the other hand, when the content is more than about 0.2%, in addition to the saturation of the effect described above, formation of ferrite is also suppressed so that formation of a dual-phase microstructure containing ferrite and a low temperature-transforming phase is suppressed. Hence, the content of Nb is set in the range of about 0.01% to about 0.2%.

Mo: about 0.05% to about 0.5%

Mo forms a solid solution and carbide and has an effect of increasing strength at room temperature and at a high temperature. However, when the content is more than about 0.5%, in addition to the saturation of the effect described above, the cost is increased. Hence, Mo at a content of about 0.5% or less may be added. To efficiently obtain the effect of increasing strength, the content is preferably set to about 0.05% or more. In addition, as an element having an effect of delaying transformation, Mo has an effect of suppressing formation of pearlite and, to efficiently obtain the effect described above, the content is preferably set to about 0.05% or more.

Cr: about 0.05% to about 1.5%

Cr suppresses formation of pearlite, contributes to formation of a dual-phase micro-structure containing ferrite and a low temperature-transforming phase, and contributes to the in-crease in strength by hardening of the low temperature-transforming phase. However, when the content is less than about 0.05%, the effect cannot be obtained. On the other hand, even when the content is increased to more than about 1.5%, in addition to the saturation of the above effect, formation of ferrite is also suppressed and, as a result, formation of a dual-phase microstructure is suppressed. Hence, the content of Cr is set to about 0.05% to about 1.5%.

Under the conditions in which at least one of Nb, Mo, and Cr is contained and the content of a low C is less than about 0.1%, in view of the suppression of formation of pearlite, equation (3) should be satisfied and, in addition, in view of the promotion of formation of ferrite at a volume fraction of about 5% to about 70%, equation (4) should be satisfied.

In addition, in the case in which Ni and Cu are not added which will be described later, instead of equation (3), equation (1) should be used and, instead of equation (4), equation (2) should be used.

In addition to the elements described above, the following elements may also be added whenever necessary.

Ni: about 0.05% to about 1%

Ni is an effective element for improving strength, toughness, and corrosion resistance. In addition, when Cu is added, Cu cracking which may occur in rolling can be effectively prevented. However, since Ni is expensive and the effect thereof is saturated even when the content is excessively increased, the content is preferably set in the range of about 0.05% to about 1%. In particular, in view of Cu cracking, the content of Ni is preferably set so that the content (%) of Cu×0.3 or more is satisfied.

Cu: about 0.05% to about 1%

Cu is added to improve strength and corrosion resistance. However, to efficiently obtain the above effect, the content must be more than about 0.05% or more and, on the other hand, when the content is more than about 1%, since hot embrittlement may occur and the toughness is also decreased, the content is preferably set in the range of about 0.05% to about 1%.

V: about 0.005% to about 0.2%

V forms a carbonitride and has the effect of increasing strength by formation of a microstructure having a finer microstructure and by enhancement of precipitation. However, the effect is unclear at a content of less than about 0.005%. In addition, when the content is more than about 0.2%, since the effect is saturated and problems of cracking in continuous casting and the like may arise, the content may be in the range of about 0.005% to about 0.2%.

Ti: about 0.005% to about 0.2%

Ti is an active element for forming a nitride, and by the addition of approximate N equivalents (N %×48/14), N aging is suppressed. Also, when addition of B is performed, Ti may be added so that the effect of B is not suppressed by precipitation and fixation thereof in the form of BN caused by N contained in steel. When Ti is further added, carbides having a microstructure are formed and, as a result, the strength is increased. The effect cannot be obtained at a content of less than about 0.005%, and in particular, (N %×48/14) or more is preferably added. On the other hand, when the content is more than about 0.2%, since a large and coarse nitride may be formed, toughness and pipe-expansion properties are degraded. Hence, the content may be set to about 0.2% or less.

B: about 0.0005% to about 0.0035%

B suppresses grain boundary cracking as an element for enhancing grain boundary and contributes to the improvement in toughness. To efficiently obtain the above effect, the content must be about 0.0005% or more. On the other hand, even when the content is excessively increased, in addition to the saturation of the above effect, the ferrite transformation is suppressed. Hence, the content is set to about 0.0035% as an upper limit.

Ca: about 0.001% to about 0.005%

Ca is added so that an inclusion is formed into a spherical shape. However, to efficiently obtain the above effect, the content must be about 0.001% or more and, when the content is more than about 0.005%, since the effect is saturated, the content may be set in the range of about 0.001% to about 0.005%.

Next a preferred range of the composition will be described.

To ensure a low YR and uniform elongation which are effective for the pipe-expansion property, the microstructure of a steel pipe is preferably a dual-phase microstructure which contains a substantially soft ferrite phase and a hard low temperature-transforming phase and, to ensure a TS of about 600 MPa or more, the microstructure preferably contains ferrite at a volume fraction of about 5% to about 70% and the balance substantially composed of a low temperature-transforming phase. Since a significantly superior pipe-expansion property can be obtained, a ferrite volume fraction of about 5% to about 50% is more preferable, and in addition, a volume fraction of about 5% to about 30% is even more preferable. In addition, in the low temperature-transforming phase, bainitic ferrite (which is equivalent to acicular ferrite) is also contained as described above. However, unless the content of C is less than about 0.02% in the composition, bainitic ferrite is hardly formed.

Next, a selected manufacturing method will be described.

Steel having the composition described above is preferably formed into a raw material for steel pipes such as billets by melting using a known melting method such as a converter or an electric furnace, followed by casting using a known casting method such as a continuous casting method or an ingot-making method. Alternatively, after being formed by a continuous casting method or the like, a slab may be formed into a billet by rolling.

In addition, to decrease inclusions, measures to decrease inclusions, such as floatation treatment or coagulation suppression, are preferably taken when steel making and casting are performed. In addition, by forging in continuous casting or heat treatment in a soaking furnace, central segmentation may be decreased.

Next, after the raw material for steel pipes thus formed is heated, pipe forming by hot working is performed using a general Mannesmann-plug mill method, Mannesmann-mandrel mill method, or hot extrusion method, thereby forming a seamless steel pipe having desired dimensions. In this step, in view of a low YR and uniform elongation, final rolling is preferably finished at a temperature of 800° C. or more so that a working strain is not allowed to remain. Cooling may be performed by general air cooling. In addition, in the range of the composition, as long as unique low-temperature rolling in pipe forming or quenching thereafter is not performed, ferrite is formed, the balance is substantially composed of a low temperature-transforming phase, and the volume fraction of the ferrite is approximately in the range of 5% to 70%.

In addition, even in the case in which a predetermined microstructure is not obtained by an unusual pipe-forming step such as low-temperature rolling in pipe forming or quenching performed thereafter, when normalizing treatment is performed, a predetermined microstructure can be obtained. Furthermore, even when the rolling finish temperature is set to about 800° C. or more in pipe forming, non-uniform and anisotropic material properties may be generated depending on the manufacturing process in some cases. In that case, normalizing treatment may also be performed whenever desired. In the range of the composition, although the microstructure obtained after normalizing treatment is approximately equivalent to that of a microstructure obtained right after pipe forming, the non-uniform and anisotropic material properties generated in pipe forming are decreased and, as a result, a more superior pipe-expansion property can be obtained. Incidentally, in a temperature range of $Ac_3$ or more, the temperature of the normalizing treatment is preferably about 1,000° C. or less and is more preferably in the range of about 950° C. or less.

Figure 2:
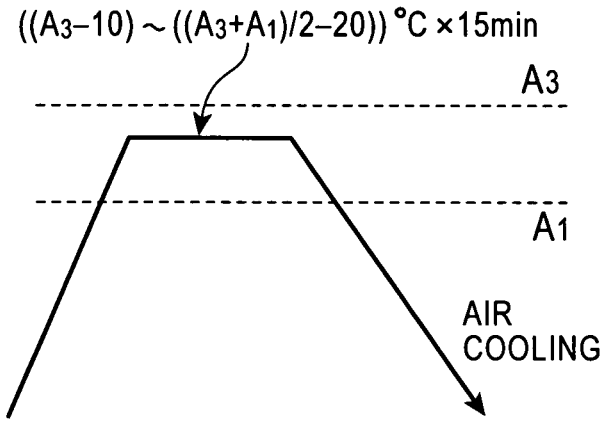
FIGS. 2(*a*), 2(*b*), 2(*c*), and 2(*d*) are each a pattern showing an example of dual-phase heat treatment.
Figure 2:
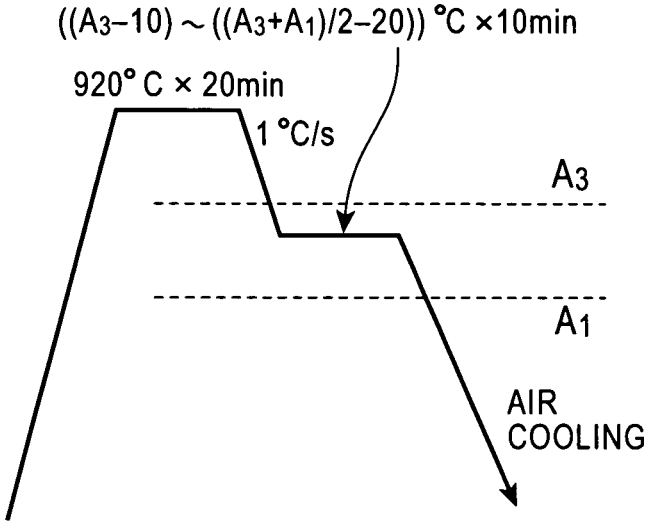
Figure 2:
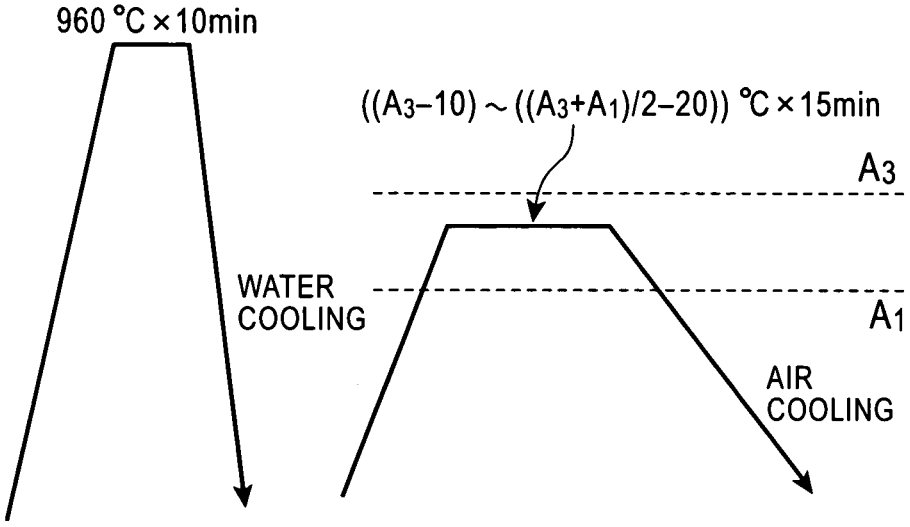
Figure 2:
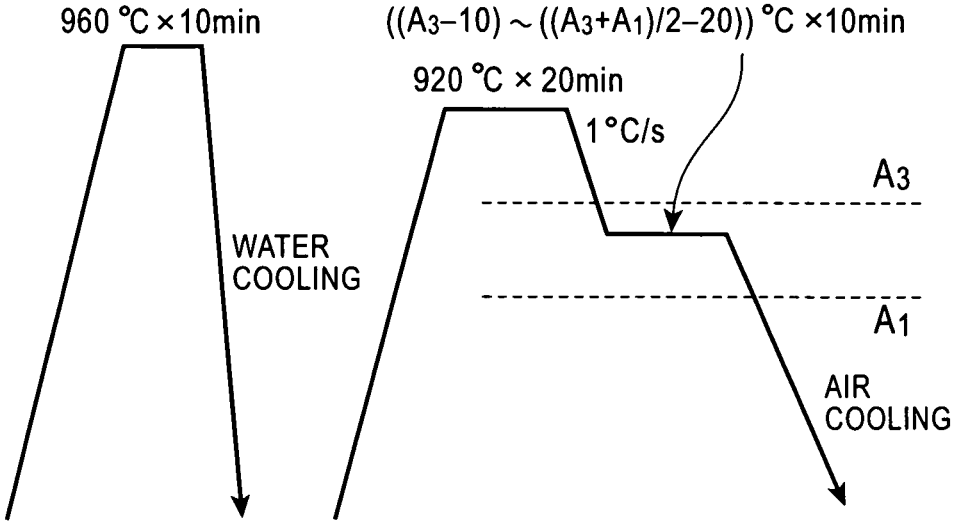

In addition, to realize a lower YR, instead of the normalizing treatment, after the steel pipe is finally held in an ($\alpha/\gamma$) dual-phase region, air cooling may be performed. In the range of the composition, although a dual-phase microstructure containing ferrite and a low temperature-transforming phase is also obtained as is the case of the normalizing treatment, the strength of the ferrite is further decreased, and the decrease in YR is promoted. To obtain the effect described above, the holding time should be about five minutes or more. In addition, since the effect described above does not depend on thermal hysteresis before the holding step performed in a dual-phase region, as shown in FIG. 2(*a*), 2(*b*), 2(*c*), and 2(*d*), heat treatment, such as heating to a $\gamma$ region, followed by cooling directly to an ($\alpha/\gamma$) dual-phase region, or heating to a dual-phase region after quenching, may be performed to obtain the effect of grain refinement.

In this case, although point $A_1$ and point $A_3$ defining the ($\alpha/\gamma$) dual-phase region are preferably measured accurately, the following equations may be conveniently used instead:

$$A_3(°\,C.)=910-203\times\sqrt{C}+44.7\times Si-30\times Mn-15.2\times Ni-2\times Cu-11\times Cr+31.5\times Mo+104\times V+700\times P+400\times Al+400\times Ti$$

$$A_1(°\,C.)=723+29.1\times Si-10.7\times Mn-16.9\times Ni+16.9\times Cr.$$

In the above equations, the symbol of the elements represents the content (mass percent) of the element contained in the steel.

EXAMPLE

After various types of steel having compositions shown in Table 1 were each cast into a steel ingot having a weight of 100 kg by vacuum melting, ingots were then formed into billets by hot forging, followed by hot working for forming pipes using a model seamless rolling machine, thereby obtaining seamless steel pipes each having an external diameter of 4 inches (101.6 mm) and a wall thickness of ⅜ inches (9.525 mm). Rolling finish temperatures in this process are shown in Tables 2, 3, and 4.

Some of the steel pipes thus formed were processed by heat treatment such as normalizing treatment, dual-phase heat treatment (FIG. 2(*a*), 2(*b*), 2(*c*), and 2(*d*)) or Q/T treatment. The normalizing treatment was performed by heating to a temperature of 890° C. for 10 minutes, followed by air cooling. In the Q/T treatment, after heating was performed to 920° C. for 60 minutes, water cooling was performed, and tempering treatment was performed at a temperature of 430 to 530° C. for 30 minutes.

In this example, transformation points $A_1$ and $A_3$ of the dual-phase heat treatment were obtained by the following equations:

$$A_3(°\,C.)=910-203\times\sqrt{C}+44.7\times Si-30\times Mn-15.2\times Ni-2\times Cu-11\times Cr+31.5\times Mo+104\times V+700\times P+400\times Al+400\times Ti$$

$$A_1(°\,C.)=723+29.1\times Si-10.7\times Mn-16.9\times Ni+16.9\times Cr.$$

For each steel pipe, the microstructure and fraction of ferrite (volume fraction) were examined by observation using an optical microscope and a SEM (scanning electron microscope). In addition, the tensile properties and pipe-expansion properties were also measured. The results are shown in Tables 2, 3, and 4. In this measurement, the tensile test was carried out in accordance with the tensile testing method defined by JIS Z2241, and as the test piece, JIS 12B was used which was defined in accordance with JIS Z2201. The pipe-expansion property was evaluated by an expansion ratio (a limit of expansion ratio) at which a pipe was expandable without causing any non-uniform deformation during pipe expansion and, in particular, an expansion ratio at which the rate of wall-thickness deviation after pipe expansion did not exceed the rate of wall-thickness deviation before pipe expansion+5% was used. The rate of wall-thickness deviation was obtained by measuring thicknesses at 16 points along the cross-section of the pipe at regular angular intervals of 22.5° using an ultrasonic thickness meter. For the pipe-expansion test, as shown in FIG. 1, a pressure-expansion method was performed in which plugs 2 having various maximum external diameters $D_1$, each of which was larger than an internal diameter $D_0$ of a steel pipe 1 before expansion, were each inserted thereinto and then mechanically drawn out in a direction in which the plug was to be drawn out so that the inside diameter of the steel pipe is expanded, and the expansion ratio was obtained from the average internal diameters before and after the pipe expansion.

From Tables 2, 3, and 4, it was found that a superior pipe-expansion property having a limit of expansion ratio of 40% or more can be obtained.

INDUSTRIAL APPLICABILITY

Even when the expansion ratio is more than 30%, a steel pipe having a superior pipe-expansion property and a TS of 600 MPa or more can be supplied at an inexpensive price.

TABLE 1

| Steel No. | C | Si | Mn | P | S | Al | N | O |
|---|---|---|---|---|---|---|---|---|
| A | 0.048 | 0.54 | 3.36 | 0.015 | 0.003 | 0.032 | 0.0044 | 0.0018 |
| B | 0.081 | 0.21 | 3.05 | 0.011 | 0.001 | 0.040 | 0.0034 | 0.0021 |
| C | 0.025 | 0.20 | 2.85 | 0.008 | 0.001 | 0.027 | 0.0026 | 0.0022 |
| D | 0.051 | 0.19 | 2.20 | 0.012 | 0.005 | 0.041 | 0.0031 | 0.0029 |
| E | 0.047 | 0.30 | 3.30 | 0.010 | 0.002 | 0.035 | 0.0019 | 0.0008 |
| F | 0.040 | 0.21 | 3.88 | 0.012 | 0.001 | 0.032 | 0.0022 | 0.0020 |

TABLE 1-continued

| | | | | | | | | |
|---|---|---|---|---|---|---|---|---|
| G | 0.008 | 0.25 | 3.22 | 0.013 | 0.003 | 0.038 | 0.0034 | 0.0018 |
| H | 0.16 | 0.36 | 3.10 | 0.014 | 0.001 | 0.040 | 0.0048 | 0.0032 |
| I | 0.056 | 0.19 | 1.58 | 0.015 | 0.004 | 0.039 | 0.0030 | 0.0029 |
| J | 0.25 | 0.21 | 1.45 | 0.012 | 0.002 | 0.030 | 0.0041 | 0.0037 |
| K | 0.045 | 0.29 | 3.04 | 0.009 | 0.001 | 0.023 | 0.0036 | 0.0020 |
| L | 0.081 | 0.24 | 2.21 | 0.010 | 0.002 | 0.018 | 0.0021 | 0.0009 |
| M | 0.047 | 0.64 | 1.65 | 0.011 | 0.001 | 0.040 | 0.0034 | 0.0028 |
| N | 0.032 | 0.35 | 2.70 | 0.016 | 0.003 | 0.041 | 0.0042 | 0.0019 |
| O | 0.087 | 0.21 | 2.56 | 0.015 | 0.003 | 0.022 | 0.0045 | 0.0033 |
| P | 0.092 | 0.34 | 2.21 | 0.018 | 0.005 | 0.032 | 0.0038 | 0.0020 |

| Steel No. | Nb | Cr | Mo | Ni | Cu | V | Ti | B | Ca | P1 | P2 | Remarks |
|---|---|---|---|---|---|---|---|---|---|---|---|---|
| A | 0.044 | — | — | — | — | — | — | — | — | 3.63 | 3.66 | Adequate |
| B | 0.021 | 0.10 | — | — | — | — | 0.017 | — | — | 3.14 | 3.44 | Adequate |
| C | 0.022 | 0.11 | 0.20 | 0.88 | — | — | 0.015 | 0.0018 | 0.0021 | 3.73 | 3.60 | Adequate |
| D | 0.024 | 0.82 | — | — | — | 0.045 | 0.021 | 0.0012 | — | 2.94 | 3.41 | Adequate |
| E | 0.081 | — | — | 0.50 | 0.22 | — | — | 0.0025 | 0.0018 | 3.52 | 3.68 | Adequate |
| F | 0.019 | — | 0.31 | — | — | 0.022 | — | — | — | 4.69 | 4.44 | Adequate |
| G | 0.045 | 0.20 | — | 0.20 | 0.22 | — | 0.014 | 0.0030 | 0.0022 | 3.53 | 3.63 | Inadequate |
| H | 0.021 | — | — | — | — | 0.021 | 0.021 | — | — | 3.10 | 3.63 | Inadequate |
| I | 0.035 | — | — | 0.21 | 0.19 | 0.055 | 0.014 | 0.0012 | — | 1.70 | 1.92 | Inadequate |
| J | — | 1.12 | 0.72 | — | — | 0.17 | 0.009 | — | — | 4.33 | 4.92 | Inadequate |
| K | — | 0.41 | — | — | — | — | — | — | — | 3.41 | 3.67 | Adequate |
| L | — | — | 0.25 | — | — | — | — | — | — | 2.86 | 2.84 | Adequate |
| M | — | 1.23 | 0.13 | 0.20 | — | — | 0.015 | — | — | 3.16 | 3.50 | Adequate |
| N | 0.034 | — | 0.20 | — | — | 0.035 | 0.012 | — | 0.0020 | 3.22 | 3.02 | Adequate |
| O | — | 1.23 | 0.13 | 0.32 | 0.45 | — | — | 0.0016 | 0.0021 | 4.24 | 5.01 | Inadequate |
| P | — | — | — | — | — | 0.028 | 0.008 | — | — | 2.21 | 2.48 | Inadequate |

P1 = Mn + 0.9 × Cr + 2.6 × Mo + 0.3 × Ni + 0.3 × Cu

P2 = 4 × C − 0.3 × × Si + Mn + 1.3 × Cr + 1.5 × Mo + 0.3 × Ni + 0.6 × Cu

In this table, the symbol of the element represents the content (mass percent) of the element contained in the steel.

TABLE 2

| Steel pipe no. | Steel no. | Rolling finish temperature/ ° C. | Heat treatment | Substantial microstructure | α Fraction/ volume % | Tensile properties YS/ MPa | TS/ MPa | YR/% | u-El/% | El/% |
|---|---|---|---|---|---|---|---|---|---|---|
| 1 | A | 820 | — | α + Low temperature-transforming phase | 18 | 483 | 662 | 73 | 15 | 34 |
| 2 | A | 820 | Normalizing treatment | α + Low temperature-transforming phase | 20 | 464 | 653 | 71 | 16 | 35 |
| 3 | B | 815 | — | α + Low temperature-transforming phase | 11 | 596 | 852 | 70 | 14 | 32 |
| 4 | B | 815 | Normalizing treatment | α + Low temperature-transforming phase | 12 | 574 | 844 | 68 | 15 | 34 |
| 5 | B | 730 | Normalizing treatment | α + Low temperature-transforming phase | 14 | 591 | 857 | 69 | 16 | 33 |
| 5' | B | 820 | Dual-phase region I | α + Low temperature-transforming phase | 31 | 454 | 782 | 58 | 19 | 38 |
| 6 | C | 855 | — | α + Low temperature-transforming phase | 9 | 456 | 634 | 72 | 18 | 40 |
| 7 | C | 750 | Normalizing treatment | α + Low temperature-transforming phase | 11 | 468 | 641 | 73 | 17 | 39 |
| 8 | D | 845 | — | α + Low temperature-transforming phase | 22 | 519 | 821 | 72 | 15 | 37 |
| 9 | D | 730 | Normalizing treatment | α + Low temperature-transforming phase | 17 | 543 | 734 | 74 | 15 | 36 |
| 10 | E | 860 | — | α + Low temperature-transforming phase | 15 | 564 | 842 | 67 | 16 | 34 |

| Steel pipe no. | Rate of wall-thickness deviation before pipe expansion/% | Rate of wall-thickness deviation after pipe expansion/% | Limit of expansion ratio/% | Remarks |
|---|---|---|---|---|
| 1 | 4.2 | 9.0 | 43 | Example |
| 2 | 3.9 | 8.4 | 45 | Example |
| 3 | 2.8 | 7.7 | 50 | Example |
| 4 | 2.9 | 7.5 | 53 | Example |
| 5 | 2.1 | 7.0 | 50 | Example |
| 5' | 3.2 | 8.2 | 53 | Example |
| 6 | 6.7 | 11.5 | 48 | Example |
| 7 | 6.0 | 10.8 | 46 | Example |

TABLE 2-continued

| | | | | |
|---|---|---|---|---|
| 8 | 4.0 | 8.8 | 50 | Example |
| 9 | 7.7 | 12.3 | 50 | Example |
| 10 | 4.2 | 9.0 | 55 | Example |

α: Ferrite,
YS: Yield Strength,
TS: Tensile Strength,
YR: Yield Ratio,
u-El: Uniform Elongation,
El: Elongation

TABLE 3

| Steel pipe no. | Steel no. | Rolling finish temperature/° C. | Heat treatment | Substantial microstructure | α Fraction/volume % | Tensile properties YS/MPa | TS/MPa | YR/% | u-El/% | El/% |
|---|---|---|---|---|---|---|---|---|---|---|
| 11 | E | 860 | Normalizing treatment | α + Low temperature-transforming phase | 17 | 542 | 834 | 65 | 16 | 36 |
| 11' | E | 860 | Dual-phase region II | α + Low temperature-transforming phase | 34 | 452 | 780 | 58 | 19 | 38 |
| 12 | F | 900 | — | α + Low temperature-transforming phase | 9 | 666 | 952 | 70 | 13 | 29 |
| 13 | F | 760 | Normalizing treatment | α + Low temperature-transforming phase | 10 | 649 | 940 | 69 | 14 | 30 |
| 14 | G | 840 | — | Low temperature-transforming phase | — | 470 | 546 | 86 | 10 | 31 |
| 15 | H | 825 | — | α + Pearlite + low temperature-transforming phase | 37 | 514 | 650 | 79 | 12 | 35 |
| 16 | H | 740 | — | α + Pearlite + low temperature-transforming phase | 51 | 571 | 705 | 81 | 11 | 31 |
| 17 | I | 825 | — | α + Pearlite + low temperature-transforming phase | 32 | 434 | 543 | 80 | 16 | 40 |
| 18 | I | 825 | Q/T Treatment | Tempered martensite | — | 626 | 688 | 91 | 9 | 34 |
| 19 | J | 830 | — | α + Pearlite | 62 | 504 | 586 | 86 | 14 | 39 |
| 20 | J | 830 | Q/T Treatment | Tempered martensite | — | 599 | 642 | 93 | 7 | 32 |

| Steel pipe no. | Rate of wall-thickness deviation before pipe expansion/% | Rate of wall-thickness deviation after pipe expansion/% | Limit of expansion ratio/% | Remarks |
|---|---|---|---|---|
| 11 | 4.2 | 9.2 | 57 | Example |
| 11' | 3.7 | 8.7 | 53 | Example |
| 12 | 2.8 | 7.8 | 53 | Example |
| 13 | 3.8 | 8.4 | 53 | Example |
| 14 | 7.2 | 12.0 | 28 | Comparative example |
| 15 | 3.8 | 8.5 | 33 | Comparative example |
| 16 | 5.5 | 10.0 | 28 | Comparative example |
| 17 | 7.1 | 12.0 | 33 | Comparative example |
| 18 | 7.1 | 11.8 | 31 | Comparative example |
| 19 | 4.4 | 9.0 | 36 | Comparative example |
| 20 | 4.4 | 9.2 | 33 | Comparative example |

α: Ferrite,
YS: Yield Strength,
TS: Tensile Strength,
YR: Yield Ratio,
u-El: Uniform Elongation,
El: Elongation

TABLE 4

| Steel pipe no. | Steel no. | Rolling finish temperature/ ° C. | Heat treatment | Substantial microstructure | α Fraction/ volume % | Tensile properties YS/ MPa | TS/ MPa | YR/% | u-El/% | El/% |
|---|---|---|---|---|---|---|---|---|---|---|
| 21 | K | 830 | — | α + Low temperature-transforming phase | 38 | 456 | 702 | 65 | 17 | 38 |
| 22 | K | 750 | Normalizing treatment | α + Low temperature-transforming phase | 36 | 462 | 689 | 67 | 18 | 39 |
| 23 | K | 830 | Dual-phase region IV | α + Low temperature-transforming phase | 48 | 360 | 631 | 57 | 20 | 42 |
| 24 | L | 825 | — | α + Low temperature-transforming phase | 36 | 439 | 708 | 62 | 17 | 37 |
| 25 | L | 760 | Dual-phase region II | α + Low temperature-transforming phase | 42 | 373 | 678 | 55 | 19 | 39 |
| 26 | M | 815 | — | α + Low temperature-transforming phase | 19 | 624 | 892 | 70 | 14 | 31 |
| 27 | M | 800 | Normalizing treatment | α + Low temperature-transforming phase | 21 | 577 | 888 | 65 | 15 | 32 |
| 28 | N | 820 | — | α + Low temperature-transforming phase | 42 | 450 | 693 | 65 | 19 | 39 |
| 29 | N | 730 | Normalizing treatment | α + Low temperature-transforming phase | 40 | 458 | 684 | 67 | 18 | 38 |
| 30 | N | 830 | Dual-phase region IV | α + Low temperature-transforming phase | 49 | 386 | 655 | 59 | 20 | 41 |
| 31 | O | 830 | — | Low temperature-transforming phase | — | 791 | 953 | 83 | 7 | 21 |
| 32 | P | 820 | — | α + Pearlite + low temperature-transforming phase | 46 | 523 | 654 | 80 | 15 | 34 |
| 33 | P | 730 | Normalizing treatment | α + Pearlite + low temperature-transforming phase | 41 | 503 | 637 | 79 | 16 | 35 |

| Steel pipe no. | Rate of wall-thickness deviation before pipe expansion/% | Rate of wall-thickness deviation after pipe expansion/% | Limit of expansion ratio/% | Remarks |
|---|---|---|---|---|
| 21 | 3.8 | 8.8 | 48 | Example |
| 22 | 4.2 | 9.1 | 50 | Example |
| 23 | 3.8 | 8.8 | 55 | Example |
| 24 | 3.0 | 7.9 | 50 | Example |
| 25 | 2.1 | 7.1 | 53 | Example |
| 26 | 6.4 | 11.3 | 45 | Example |
| 27 | 5.7 | 10.6 | 48 | Example |
| 28 | 3.8 | 8.7 | 53 | Example |
| 29 | 4.2 | 9.1 | 55 | Example |
| 30 | 2.7 | 7.7 | 57 | Example |
| 31 | 3.1 | 8.0 | 28 | Comparative example |
| 32 | 5.4 | 10.4 | 30 | Comparative Example |
| 33 | 5.4 | 10.3 | 33 | Comparative Example |

α: Ferrite,
YS: Yield Strength,
TS: Tensile Strength,
YR: Yield Ratio,
u-El: Uniform Elongation,
El: Elongation

The invention claimed is:

1. A seamless expandable oil country tubular article comprising: on a mass percent basis, about 0.010% to less than about 0.10% of C, about 0.05% to about 1% of Si, about 2.21% to about 4% of Mn, about 0.03% or less of P, about 0.015% or less of S, about 0.01% to about 0.06% of Al, about 0.007% or less of N, and about 0.005% or less of O; at least one of Nb, Mo, and Cr which are contained in the range of about 0.01% to about 0.2% of Nb, about 0.05% to about 0.5% of Mo, and about 0.05% to about 1.5% of Cr, so that equations (1) and (2) are satisfied; and Fe and unavoidable impurities as the balance:

$$Mn+0.9Cr+2.6Mo \geqq 2.0 \quad (1)$$

$$4C-0.3Si+Mn+1.3Cr+1.5Mo \leqq 4.5 \quad (2)$$

wherein the steel article has a microstructure that contains soft ferrite at a volume fraction of about 5% to about 70% and the balance substantially composed of bainite, martensite, bainitic ferrite, or a mixture containing at least two thereof and wherein the steel article has a yield ratio of no more than 74% and uniform deformation during expansion at an expansion ratio of 30% or more.

2. The article according to claim 1, further comprising, instead of a part of Fe, at least one of about 0.05% to about 1% of Ni, about 0.05% to about 1% of Cu, about 0.005% to about 0.2% of V, about 0.005% to about 0.2% of Ti, about 0.0005% to about 0.0035% of B, and about 0.001% to about 0.005% of Ca.

3. A seamless expandable oil country tubular article comprising: on a mass percent basis, about 0.010% to less than about 0.10% of C, about 0.05% to about 1% of Si, about 2.21% to about 4% of Mn, about 0.03% or less of P, about 0.015% or less of S, about 0.01% to about 0.06% of Al, about 0.007% or less of N, and about 0.005% or less of O; at least one of Nb, Mo, and Cr which are contained in the range of about 0.01% to about 0.2% of Nb, about 0.05% to about 0.5% of Mo, and about 0.05% to about 1.5% of Cr, so that equations (3) and (4) are satisfied:

$$Mn+0.9Cr+2.6Mo+0.3Ni+0.3Cu \geqq 2.0 \quad (3)$$

$$4C-0.3Si+Mn+1.3Cr+1.5Mo+0.3Ni+0.6Cu \leqq 4.5 \quad (4)$$

wherein the steel article has a microstructure that contains soft ferrite at a volume fraction of about 5% to about 70% and the balance substantially composed of bainite, martensite, bainitic ferrite, or a mixture containing at least two thereof and wherein the steel article has a yield ratio of no more than 74% and uniform deformation during expansion at an expansion ratio of 30% or more.

4. A method for manufacturing a seamless expandable oil country tubular pipe comprising:

heating a raw material for a steel pipe, the raw material containing, on a mass percent basis, about 0.010% to less than about 0.10% of C, about 0.05% to about 1% of Si, about 2.21% to about 4% of Mn, about 0.03% or less of P, about 0.015% or less of S, about 0.01% to about 0.06% of Al, about 0.007% or less of N, and about 0.005% or less of O, at least one of about 0.01% to about 0.2% of Nb, about 0.05% to about 0.5% of Mo, and about 0.05 to about 1.5% of Cr, optionally, at least one of about 0.05% to about 1% of Ni, about 0.05% to about 1% of Cu, about 0.005% to about 0.2% of V, about 0.005% to about 0.2% of Ti, about 0.0005% to about 0.0035% of B, and about 0.001% to about 0.005% of Ca, so that equations (3) and (4) are satisfied, and Fe and unavoidable impurities as the balance;

forming the pipe by a seamless steel pipe-forming process which is performed at a rolling finish temperature of about 800° C. or more; and optionally, performing normalizing treatment after pipe forming is performed by the seamless steel pipe-forming process:

$$Mn+0.9Cr+2.6Mo+0.3Ni+0.3Cu \geqq 2.0 \quad (3)$$

$$4C-0.3Si+Mn+1.3Cr+1.5Mo+0.3Ni+0.6Cu \leqq 4.5 \quad (4)$$

such that the steel pipe has a microstructure containing soft ferrite at a volume fraction of about 5% to about 70% and the balance substantially composed of bainite, martensite, bainitic ferrite, or a mixture containing at least two thereof and wherein the steel article has a yield ratio of no more than 74% and uniform deformation during expansion at an expansion ratio of 30% or more.

5. A method for manufacturing a seamless expandable oil country tubular pipe comprising: after heating of the raw material according to claim 4 is performed and pipe forming is performed by a seamless steel pipe-forming process, holding the pipe in a region of from point $A_1$ to point $A_3$ for about five minutes or more as a final heat treatment, and then air cooling the pipe.

6. The article according to claim 3, further comprising, instead of a part of Fe, at least one of about 0.05% to about 1% of Ni, about 0.05% to about 1% of Cu, about 0.005% to about 0.2% of V, about 0.005% to about 0.2% of Ti, about 0.0005% to about 0.0035% of B, and about 0.001% to about 0.005% of Ca.

* * * * *